US005827413A

United States Patent [19]

Yamaguchi et al.

[11] Patent Number: 5,827,413

[45] Date of Patent: Oct. 27, 1998

[54] LOW HYDROGEN OVER VOLTAGE CATHODE AND PROCESS FOR PRODUCTION THEREOF

[75] Inventors: Kazuhisa Yamaguchi; Kanji Yoshimitsu; Satoshi Yoshida; Kazumasa Suetsugu; Takashi Sakaki, all of Yamaguchi, Japan

[73] Assignee: Tosoh Corporation, Yamaguchi, Japan

[21] Appl. No.: 736,083

[22] Filed: Oct. 24, 1996

[30] Foreign Application Priority Data

Oct. 25, 1995 [JP] Japan ..... 7-277561
Apr. 19, 1996 [JP] Japan ..... 8-098386

[51] Int. Cl.[6] ..... C25B 11/04

[52] U.S. Cl. ..... 204/293; 205/232; 205/236; 205/238; 205/252; 205/255; 204/290 R

[58] Field of Search ..... 204/293, 290 R; 429/59, 101; 205/176, 232, 236, 238, 241, 252, 255, 261, 269, 300

[56] References Cited

U.S. PATENT DOCUMENTS 4,302,322 11/1981 Oda et al. ..... 204/293
4,801,368 1/1989 Yamashita et al. ..... 204/293

FOREIGN PATENT DOCUMENTS

WO8500389 1/1985 WIPO .

*Primary Examiner*—Bruce F. Bell
*Attorney, Agent, or Firm*—Sughrue, Mion, Zinn, Macpeak & Seas, PLLC

[57] ABSTRACT

A low hydrogen overvoltage cathode is provided which comprises an electroconductive base material coated with an alloy layer containing cobalt and tin at least at a content of tin ranging from 0.01 to 95% by weight. A process is also provided for producing the low hydrogen voltage cathode, wherein cobalt and tin at least are electrolytically co-deposited onto a surface of an electroconductive base material from a plating bath containing cobalt ions, tin ions, and a complexing agent.

6 Claims, No Drawings

LOW HYDROGEN OVER VOLTAGE CATHODE AND PROCESS FOR PRODUCTION THEREOF

BACKGROUND OF THE INVENTION

1. Field of the Invention

The present invention relates to a low hydrogen overvoltage cathode for electrolysis of water or an aqueous alkali metal chloride such as sodium chloride, and also to a process for producing the low hydrogen overvoltage cathode.

2. Description of the Related Art

Industrial electrolysis of water or an aqueous alkali metal chloride consumes a large amount of electric energy, so that various energy saving techniques are being developed for the industrial electrolysis. The Energy-saving techniques means a substantial decrease of electrolysis voltage including theoretical electrolysis voltage, solution resistance, diaphragm resistance, cathode overvoltage, and anode overvoltage. In particular, the overvoltages, which largely depend on the electrode material and the electrode surface state, attracted attention of many research scientists, and many developments have been made therefor. In the ion-exchange process for sodium chloride electrolysis, the decrease of anode overvoltage was noticed, and has been studied actively. Consequently, anodes have been completed which do not involve problems regarding the anode overvoltage, and are widely used industrially.

On the other hand, many proposals have been presented regarding the low hydrogen overvoltage cathode which exhibits a hydrogen overvoltage lower by 200–250 mV in comparison with a usual iron cathode exhibiting a hydrogen overvoltage of 400 mV. For example, a hydrogen-absorbing alloy or a platinum group metal oxide is deposited onto an electrode base material surface (Japanese Patent Laid-Open Publications 59-25940 and 6-146046); and a coating layer of an alloy of a transition metal such as iron, cobalt, and nickel, and tungsten or molybdenum is formed by plating on an electrode base material surface (Japanese Patent Publication 40-9130). However, the former electrode having a hydrogen-absorbing alloy or a platinum group oxide deposited thereon is made from a relatively expensive material to result in a high production cost, whereas the latter electrode coated with an alloy can be produced at a low cost but is not sufficient in lowering the hydrogen overvoltage, and deteriorates rapidly.

SUMMARY OF THE INVENTION

The inventors of the present invention made a comprehensive study to solve the above problems about binary-alloy coatings. Consequently, it has been found that a binary alloy composed of cobalt and tin in a specified composition range exhibits low hydrogen overvoltage characteristics and is sufficiently durable. Based on the findings, the present invention has been completed.

An object of the present invention is to provide a cathode which exhibits sufficiently low hydrogen overvoltage without deterioration in long time use for electrolysis of water or an alkali metal halide solution.

Another object of the present invention is to provide a process for producing the above cathode.

The low hydrogen overvoltage cathode of the present invention comprises an electroconductive base material coated with an alloy layer containing cobalt and tin at least at a content of tin ranging from 0.01 to 95% by weight, preferably from 0.1 to 15% by weight.

The process for producing the above low hydrogen voltage cathode, wherein cobalt and tin at least are electrolytically co-deposited onto a surface of an electroconductive base material from a plating bath containing cobalt ions, tin ions, and a complexing agent, and additionally preferably a protein compound.

DETAILED DESCRIPTION OF THE PREFERRED EMBODIMENT

The present invention provides a low hydrogen overvoltage cathode, comprising an electroconductive base material coated with an alloy layer containing cobalt and tin at least at a content of tin ranging from 0.01 to 95% by weight. A low hydrogen overvoltage of 100–160 mV, for example, at an electrolysis current density of 40 A/dm$^2$ in an aqueous 32.5% sodium hydroxide solution at 90° C. can be obtained by use of the above low hydrogen overvoltage cathode. A lower hydrogen overvoltage of 100–130 mV can be obtained under the same conditions by use of the above cathode having the cobalt-tin alloy layer of a tin content of from 0.1 to 15% by weight.

The low hydrogen overvoltage cathode can be produced by electrolytically co-depositing cobalt and tin at least onto a surface of an electroconductive base material from a plating bath containing cobalt ions, tin ions, and a complexing agent. In particular, the coating alloy layer obtained by co-deposition from a plating bath containing a protein compound at a concentration of from 0.05 to 1 g/L in addition to the above bath components is capable of keeping the low hydrogen overvoltage performance for a long term.

The electroconductive base material in the present invention includes nickel, iron, copper, titanium, stainless steel, and other metals which are resistant to caustic alkali. The shape of the electroconductive base material is not especially limited, and may be in a shape suitable for the cathode of the electrolytic cell: for example, in a shape of a flat plate, a curved plate, an expandable metal, a punched metal, a net, and a perforated panel.

The electroconductive base material is preferably subjected to usual pretreatment such as degreasing and etching. For strengthening the adhesion between the base material and the alloy layer, it is effective to plate the base material with nickel, cobalt, or nickel-sulfur, or deposition of electroconductive fine particles of carbon, a platinum group metal, or the like onto the base material to roughen the surface.

The counter electrode for the electroplating is not especially limited, and may be an insoluble electrode such as a platinum plate and a Ti plate plated by Pt.

The alloy layer for coating the electroconductive base material surface is at least composed of cobalt and tin, and the tin content in the alloy layer should be controlled to be in the range of from 0.01 to 95% by weight. The electrode having an alloy layer outside the above range will exhibit a higher cathode overvoltage.

The alloy layer preferably has a thickness in the range of from 20 to 300 $\mu$m, since a thinner alloy layer is not effective enough and a thicker alloy layer is liable to come off.

The cobalt source and the tin source to be contained in the plating bath are not especially limited. The cobalt source includes cobalt salts such as cobalt chloride, and cobalt sulfate, and mixtures thereof. The tin source includes tin salts such as tin chloride and tin sulfate, and mixtures thereof. The complexing agent to be added into the plating bath is not especially limited, and includes those capable of forming a complex with the cobalt ion, such as citrate salts, tartarate salts, pyrophosphate salts, and α-amino acids like glycine. As the result of the investigation made by the inventors of the present invention, the amount of the complexing agent is not limited, being preferably in the range of from about 0.5 to about 20 moles per mole of the total of the cobalt ions and the tin ions. The protein compound includes gelatin and peptone.

The pH of the plating bath is controlled depending on the complexing agent employed. The pH should be controlled to be in the range where the complexing agent forms a complex with the metal ion satisfactorily and the complexing agent is stable. For example, to use pyrophosphoric acid as the complexing agent, the plating bath is controlled to be at a pH of from 8 to 9, at which pH the cobalt ion forms a stable complex with the pyrophosphate ion, and the complexing agent is not decomposed. The chemicals for controlling the pH are not specially limited, and include inorganic acids such as sulfuric acid and hydrochloric acid, and inorganic bases such as sodium hydroxide and aqueous ammonia.

The temperature of the plating bath is preferably in the range of from 20° to 70° C. At a lower temperature, the plating efficiency is low and the process is uneconomical, whereas at a higher temperature, the formed coating layer is brittle. The current density for the plating is preferably in the range of from 1 to 50 A/dm$^2$.

The reason is not completely clear why the excellent low hydrogen overvoltage performance is achievable by the cobalt-tin alloy layer of the tin content ranging from 0.01 to 95% by weight. However, it is assumed that a special metastable crystal which is not shown in the phase diagram or the ASTM cards is formed entirely or locally in the alloy layer in electrolytic co-deposition of the cobalt-tin alloy layer in the production process of the present invention, and the crystallites are extremely fine. Actually, the X-ray diffraction peak of the metastable crystal disappears by heating the alloy layer above 200° C., and another X-ray diffraction peak of a stable intermetallic compound appears by the heating, which obviously shows the change of the structure. The hydrogen overvoltage of the alloy layer rises by the heat treatment to a high level of not lower than 300 mV.

In particular, in the present invention, the alloy layers containing at least cobalt and tin at a tin content ranging from 0.1 to 15% by weight have a high ability in hydrogen absorption, which is considered to give the lower hydrogen overvoltage performance synergistically with the metastable crystal state.

As is clear from the above description, the metastable crystal state having fine crystallites has to be maintained for the excellent low hydrogen overvoltage performance of the present invention. Thus heat treatment at 200° C. or higher should be avoided.

The present invention is described more specifically by reference to Examples without limiting the invention in any way.

EXAMPLES 1 TO 3

A plating bath was prepared which contained 0.126 mol/L of cobalt chloride (hexahydrate), 0.018 mol/L of tin chloride (dihydrate), 0.3 mol/L of tripotassium citrate (dihydrate), 0.3 mol/L of potassium pyrophosphate, and 2 mol/L of glycine. The pH of the prepared plating bath was 8.4, so that no pH-adjusting agent was added. The electrode base material was a nickel plate of 10 mm in diameter having been degreased with alcohol and etched by nitric acid. The counter electrode was a Ti plate plated by Pt.

A cobalt-tin alloy layer was electrodeposited onto an electrode base material to produce an electrode from the plating bath at a controlled temperature of 60° C. at the electricity quantity of 144 C by changing the plating current density for each of Examples. The tin content in the alloy layer was measured by X-ray microanalyzer. The initial hydrogen overvoltage of the electrode was measured at 90° C. in a 32.5% sodium hydroxide solution at a current density of 40 A/dm$^2$. Table 1 shows the results. After continuous electrolysis of 32.5% sodium hydroxide solution for 2000 hours at 90° C. at a current density of 40 A/dm$^2$, the hydrogen overvoltage of each of the electrodes rose by only 7–12 mV from the initial hydrogen overvoltage.

EXAMPLES 4 TO 6

The experiments were conducted in the same manner as in Examples 1–3 except that the concentration of tin chloride in the plating bath was changed to 0.004 mol/L. Table 2 shows the results.

Comparative Example 1

The plating was conducted in the same manner as in Example 2 except that the cobalt chloride (hexahydrate) was replaced by ferric chloride (tetrahydrate) and additionally 0.01 mol/L of ascorbic acid was added further to the plating bath. As the results, an iron-tin alloy containing 75% by weight of tin was deposited onto the base material, and the initial hydrogen overvoltage was 223 mV.

Comparative Example 2

The plating was conducted in the same manner as in Example 2 except that the cobalt chloride (hexahydrate) was replaced by manganese sulfate (pentahydrate) in the plating bath. As the results, a manganese-tin alloy containing 93% by weight of tin was deposited onto the base material, and the initial hydrogen overvoltage was 735 mV.

Comparative Example 3

The plating was conducted in the same manner as in Example 2 except that the tin chloride (dihyrate) was replaced by nickel chloride (hexahydrate) in the plating bath. The initial hydrogen overvoltage was 230 mV.

EXAMPLES 7 AND 8

A plating bath was prepared which contained 0.126 mol/L of cobalt chloride (hexahydrate), 0.018 mol/L of tin chloride (dihydrate), 0.6 mol/L of potassium pyrophosphate, and 2 mol/L of glycine. The pH of the prepared plating bath was 8.4, so that no pH-adjusting agent was added. The electrode base material was a nickel plate of 10 mm in diameter having been degreased with alcohol and etched by nitric acid. The counter electrode was a Ti plate plated by Pt. A cobalt-tin alloy layer was electrodeposited onto the electrode base material from the plating bath at a controlled temperature of 55° C. at the electricity quantity of 144 C by changing the plating current density for each of Examples to produce an electrode. The tin content in the alloy layer was measured by X-ray microanalyzer. The initial hydrogen overvoltage of the electrode was measured at 90° C. in a 32.5% sodium hydroxide solution at a current density of 40 A/dm$^2$. Table 3 shows the results. After continuous electrolysis of 32.5% sodium hydroxide solution for 2000 hours at 90° C. at a current density of 40 A/dm$^2$, the hydrogen overvoltage of each of the electrodes rose by only 7–13 mV from the initial hydrogen overvoltage.

EXAMPLES 9 AND 10

The experiments were conducted in the same manner as in Examples 7–8 except that the concentration of tin chloride in the plating bath was changed to 0.004 mol/L. Table 4 shows the results.

EXAMPLES 11 AND 12

A plating bath was prepared which contained 0.126 mol/L of cobalt chloride (hexahydrate), 0.036 mol/L of tin chloride (dihydrate), 0.3 mol/L of trisodium citrate (dihydrate), and 1 mol/L of glycine. The pH of the prepared plating bath was adjusted to 8.0 by addition of aqueous 28% ammonia. The electrode base material was a nickel plate of 10 mm in diameter having been degreased with alcohol and etched by nitric acid. The counter electrode was a Ti plate plated by Pt. A cobalt-tin alloy layer was electrodeposited onto an electrode base material from the plating bath at a controlled temperature of 50° C. at the electricity quantity of 144 C by changing the plating current density for each of Examples to produce an electrode. The tin content in the alloy layer was measured by X-ray microanalyzer. The initial hydrogen overvoltage of the electrode was measured at 90° C. in a 32.5% sodium hydroxide solution at a current density of 40 A/dm$^2$. Table 5 shows the results. After continuous electrolysis of 32.5% sodium hydroxide solution for 2000 hours at 90° C. at a current density of 40 A/dm$^2$, the hydrogen overvoltage of each of the electrodes rose by only 6–10 mV from the initial hydrogen overvoltage.

EXAMPLES 13 AND 14

The plating was conducted in the same manner as in Examples 11–12 except that the concentration of tin chloride in the plating bath was changed to 0.072 mol/L. Table 6 shows the results.

Comparative Example 4

The plating was conducted in the same manner as in Example 10 except that the pH of the plating bath was adjusted to pH 5.0 by addition of hydrochloric acid. The deposited alloy layer contained tin at a content of 95.9% by weight. The initial overvoltage was 396 mV.

EXAMPLES 15 TO 17

A plating bath was prepared which contained 0.398 mol/L of cobalt chloride (hexahydrate), 0.01 mol/L of tin chloride (dihydrate), 0.6 mol/L of triammonium citrate, and 1.58 mol/L of glycine. The pH of the prepared plating bath was adjusted to 7.0 by addition of aqueous ammonia. The electrode base material was a nickel mesh (SW4(means that short width is 4 mm), LW8(means that long width is 8 mm)), having been degreased with alcohol and etched by nitric acid. The counter electrode was a Pt plate. A cobalt-tin alloy layer was electrodeposited onto an electrode base material from the plating bath at a controlled temperature of 60° C. at the electricity quantity of 144 C by changing the plating current density for each of Examples to produce an electrode. The tin content in the alloy layer was measured by X-ray microanalyzer. The initial hydrogen overvoltage of the electrode was measured at 90° C. in a 32.5% sodium hydroxide solution at a current density of 40 A/dm$^2$. Table 7 shows the results. After continuous electrolysis of 32.5% sodium hydroxide solution for 2000 hours at 90° C. at a current density of 40 A/dm$^2$, the hydrogen overvoltage of each of the electrodes rose by only 10–15 mV from the initial hydrogen overvoltage.

EXAMPLES 18 TO 20

Three plating baths were prepared, each containing 0.398 mol/L of cobalt chloride (hexahydrate), 0.01 mol/L of tin chloride (dihydrate), 0.6 mol/L of triammonium citrate, and 1.58 mol/L of glycine. To each of the plating baths, peptone was added as a protein compound in an amount respectively of 0.05 g/L, 0.5 g/L, or 1 g/L. The pH of the prepared plating baths was respectively adjusted to 7.0 by addition of aqueous ammonia. The electrode base material was a nickel mesh (SW4, LW8) having been degreased with alcohol and etched by nitric acid. The counter electrode was a Pt plate. A cobalt-tin alloy layer was electrodeposited onto each electrode base material from the plating bath at a controlled temperature of 60° C. at the electricity quantity of 144 C at a plating current density of 10 A/dm$^2$ to produce electrodes. The tin content in the alloy layer was measured by X-ray microanalyzer. The initial hydrogen overvoltage of the electrode was measured at 90° C. in a 32.5% sodium hydroxide solution at a current density of 40 A/dm$^2$. Table 8 shows the results. After continuous electrolysis of 32.5% sodium hydroxide solution for 2000 hours at 90° C. at a current density of 40 A/dm$^2$, the hydrogen overvoltage of each of the electrodes rose by only about 4 mV from the initial hydrogen overvoltage.

EXAMPLES 21 TO 23

A plating bath was prepared which contained 0.398 mol/L of cobalt chloride (hexahydrate), 0.002 mol/L of tin chloride (dehydrate), 0.6 mol/L of triammonium citrate, 1.58 mol/L of glycine, and 0.5 g/L of peptone. The pH of the prepared plating bath was adjusted to 7.0 by addition of aqueous ammonia. The electrode base material was a nickel mesh (SW4, LW8) having been degreased with alcohol and etched by nitric acid. The counter electrode was a Pt plate. A cobalt-tin alloy layer was electrodeposited onto an electrode base material from the plating bath at a controlled temperature of 60° C. at the electricity quantity of 144 C by changing the plating current density for each of Examples to produce an electrode. The tin content in the alloy layer was measured by X-ray microanalyzer. The initial hydrogen overvoltage of the electrode was measured at 90° C. in a 32.5% sodium hydroxide solution at a current density of 40 A/dm$^2$. Table 9 shows the results. After continuous electrolysis of 32.5% sodium hydroxide solution for 2000 hours at 90° C. at a current density of 40 A/dm$^2$, the hydrogen overvoltage of each of the electrodes rose by only about 3 mV from the initial hydrogen overvoltage.

EXAMPLES 24 TO 26

The plating was conducted in the same manner as in Examples 21–23 except that the concentration of tin chloride in the plating bath was changed to 0.0002 mol/L. Table 10 shows the results. After continuous electrolysis of 32.5% sodium hydroxide solution for 2000 hours at 90° C. at a current density of 40 A/dm$^2$, the hydrogen overvoltage of each of the electrodes rose by only about 5 mV from the initial hydrogen overvoltage.

EXAMPLES 27 TO 29

The plating was conducted in the same manner as in Examples 18–20 except that the protein compound to be added to the plating bath is changed to gelatin. Table 11 shows the results. After continuous electrolysis of 32.5% sodium hydroxide solution for 2000 hours at 90° C. at a current density of 40 A/dm$^2$, the hydrogen overvoltage of each of the electrodes rose by only about 4 mV from the initial hydrogen overvoltage.

EXAMPLES 30 TO 34

A plating bath was prepared which contained 1.0 mol/L of cobalt chloride (hexahydrate), 0.005 mol/L of tin chloride (dihydrate), 0.6 mol/L of triammonium citrate, 1.6 mol/L of glycine, and 0.5 g/L of peptone. The pH of the prepared plating bath was adjusted to 5.0 by addition of aqueous ammonia. The electrode base material was a nickel mesh (SW4, LW8) having been degreased with alcohol and etched by nitric acid. The counter electrode was a Pt plate. A cobalt-tin alloy layer was electrodeposited onto the electrode base material from the plating bath at a controlled temperature of 55° C. at the electricity quantity of 144 C by changing the plating current density for each of Examples to produce an electrode. The initial hydrogen overvoltage of the electrode was measured at 90° C. in a 32.5% sodium hydroxide solution at a current density of 40 A/dm$^2$. The tin content in the alloy layer was determined by dissolving the alloy layer of the electrode in hydrochloric acid, and measuring the concentrations of the cobalt and the tin in the solution by inductively coupled plasma emission spectrometry. Table 12 shows the results. After continuous electrolysis of 32.5% sodium hydroxide solution for 2000 hours at 90° C. at a current density of 40 A/dm$^2$, the hydrogen overvoltage of each of the electrodes rose by only about 5 mV from the initial hydrogen overvoltage.

Comparative Example 5

A plating bath was prepared which contained 0.398 mol/L of cobalt chloride (hexahydrate), 0.6 mol/L of triammonium citrate, 1.58 mol/L of glycine, and 0.5 g/L of peptone. The pH of the prepared plating bath was adjusted to 7.0 by addition of aqueous ammonia. The electrode base material was a nickel mesh (SW4, LW8) having been degreased with alcohol and etched by nitric acid. The counter electrode was a Pt plate. A cobalt layer was electrodeposited onto an electrode base material from the plating bath at a controlled temperature of 60° C. at the electricity quantity of 144 C at a plating current density of 10 A/dm$^2$ to produce an electrode. The initial hydrogen overvoltage of the electrode was 165 mV at 90° C. in a 32.5% sodium hydroxide solution at a current density of 40 A/dm$^2$. After continuous electrolysis of 32.5% sodium hydroxide solution for 64 hours at 90° C. at a current density of 40 A/dm$^2$, this electrode showed hydrogen overvoltage of 210 mV in consequence of remarkable deterioration.

The present invention provides a cathode which is useful in electrolysis of water or an aqueous alkali metal chloride solution, exhibiting a low hydrogen overvoltage of from 100 to 160 mV, for example, at 90° C. in aqueous 32.5% sodium hydroxide solution at an electrolysis current density of 40 A/dm$^2$, and yet being capable of maintaining the overvoltage for a long term of use. The present invention also provide a process for producing the above cathode. The intended cathode performance can be obtained by the cathode, comprising an electroconductive base material coated with an alloy layer containing cobalt and tin at least at a content of tin ranging from 0.01 to 95% by weight, preferably from 0.1 to 15% by weight. The low hydrogen overvoltage cathode can be produced by electrolytically co-depositing at least cobalt and tin on a surface of an electroconductive base material in a plating bath containing cobalt ions, tin ions, and a complexing agent, and preferably a protein compound at a concentration of from 0.05 to 1 g/L in addition to the above components.

TABLE 1

| Example No. | Plating current density (A/dm$^2$) | Tin content of alloy layer (% by weight) | Initial hydrogen overvoltage (mV) |
|---|---|---|---|
| 1 | 5 | 30.2 | 114 |
| 2 | 10 | 32.6 | 115 |
| 3 | 20 | 27.8 | 128 |

TABLE 2

| Example No. | Plating current density (A/dm$^2$) | Tin content of alloy layer (% by weight) | Initial hydrogen overvoltage (mV) |
|---|---|---|---|
| 4 | 5 | 8.9 | 118 |
| 5 | 10 | 7.4 | 115 |
| 6 | 20 | 5.2 | 117 |

TABLE 3

| Example No. | Plating current density (A/dm$^2$) | Tin content of alloy layer (% by weight) | Initial hydrogen overvoltage (mV) |
|---|---|---|---|
| 7 | 5 | 92.8 | 160 |
| 8 | 10 | 65.3 | 154 |

TABLE 4

| Example No. | Plating current density (A/dm$^2$) | Tin content of alloy layer (% by weight) | Initial hydrogen overvoltage (mV) |
|---|---|---|---|
| 9 | 5 | 46.9 | 140 |
| 10 | 10 | 29.6 | 139 |

TABLE 5

| Example No. | Plating current density (A/dm$^2$) | Tin content of alloy layer (% by weight) | Initial hydrogen overvoltage (mV) |
|---|---|---|---|
| 11 | 5 | 34.9 | 125 |
| 12 | 10 | 47.8 | 127 |

TABLE 6

| Example No. | Plating current density (A/dm$^2$) | Tin content of alloy layer (% by weight) | Initial hydrogen overvoltage (mV) |
|---|---|---|---|
| 13 | 5 | 86.0 | 137 |
| 14 | 10 | 61.3 | 128 |

TABLE 7

| Example No. | Plating current density (A/dm$^2$) | Tin content of alloy layer (% by weight) | Initial hydrogen overvoltage (mV) |
|---|---|---|---|
| 15 | 5 | 26.7 | 133 |
| 16 | 10 | 20.6 | 120 |
| 17 | 20 | 14.3 | 118 |

TABLE 8

| Example No. | Peptone added to bath (g/L) | Tin content of alloy layer (% by weight) | Initial hydrogen overvoltage (mV) |
|---|---|---|---|
| 18 | 0.05 | 14.7 | 112 |
| 19 | 0.5 | 13.5 | 108 |
| 20 | 1 | 12.8 | 110 |

TABLE 9

| Example No. | Plating current density ($A/dm^2$) | Tin content of alloy layer (% by weight) | Initial hydrogen overvoltage (mV) |
|---|---|---|---|
| 21 | 5 | 5.0 | 114 |
| 22 | 10 | 2.7 | 108 |
| 23 | 20 | 1.3 | 108 |

TABLE 10

| Example No. | Plating current density ($A/dm^2$) | Tin content of alloy layer (% by weight) | Initial hydrogen overvoltage (mV) |
|---|---|---|---|
| 24 | 5 | 0.51 | 118 |
| 25 | 10 | 0.34 | 130 |
| 26 | 20 | 0.19 | 123 |

TABLE 11

| Example No. | Gelatin added to bath (g/L) | Tin content of alloy layer (% by weight) | Initial hydrogen overvoltage (mV) |
|---|---|---|---|
| 27 | 0.05 | 8.7 | 118 |
| 28 | 0.5 | 8.5 | 116 |
| 29 | 1 | 8.6 | 116 |

TABLE 12

| Example No. | Plating current density ($A/dm^2$) | Tin content of alloy layer (% by weight) | Initial hydrogen overvoltage (mV) |
|---|---|---|---|
| 30 | 1 | 0.52 | 118 |
| 31 | 10 | 0.10 | 123 |
| 32 | 20 | 0.09 | 138 |
| 33 | 30 | 0.05 | 144 |
| 34 | 50 | 0.01 | 155 |

What is claimed is:

1. A cathode which has a low hydrogen overvoltage of 100–160 mV at an electrolysis current density of 40 $A/dm^2$ in an aqueous 32.5% sodium hydroxide solution at 90° C., which cathode comprises an electroconductive base material coated with an alloy layer containing cobalt and tin at a content of tin ranging from 0.01 to 95% by weight.

2. The low hydrogen overvoltage cathode according to claim 1, wherein the alloy layer contains the tin at a content ranging from 0.1 to 15% by weight.

3. A process for producing the low hydrogen overvoltage cathode of claim 1 or 2, wherein at least cobalt and tin are electrolytically co-deposited onto a surface of an electroconductive base material from a plating bath containing cobalt ions, tin ions, and a complexing agent.

4. The process according to claim 3, wherein the plating bath contains further a protein compound at a concentration ranging from 0.05 to 1 g/L.

5. The process according to claim 3, wherein the plating bath has a pH of 5.0–9.

6. The process according to claim 3, wherein the plating bath has a pH of 5.0–8.4.

* * * * *